US005157853A

United States Patent [19]

Piana et al.

[11] Patent Number: 5,157,853

[45] Date of Patent: Oct. 27, 1992

[54] C-SHAPED SUPPORT FOR CABLE MARKING WITH AT LEAST ONE END HAVING AN OBLIQUE SHAPED SURFACE

[75] Inventors: Ivana Piana; Silvano Piana, both of Genoa, Italy

[73] Assignee: Grafoplast S.p.A., Italy

[21] Appl. No.: 857,075

[22] Filed: Mar. 16, 1992

Related U.S. Application Data

[63] Continuation of Ser. No. 666,476, Mar. 6, 1991, abandoned, which is a continuation of Ser. No. 432,036, Nov. 3, 1989, abandoned.

[30] Foreign Application Priority Data

Nov. 3, 1988 [IT] Italy ..... 12578 A/88

[51] Int. Cl.[5] ..... G09F 3/00

[52] U.S. Cl. ..... 40/316; 40/660

[58] Field of Search ..... 40/316, 317, 304, 309, 40/322, 334, 628, 665, 915, 660; 24/339, 563

[56] References Cited

U.S. PATENT DOCUMENTS

| | | | |
|---|---|---|---|
| 1,298,981 | 4/1919 | Loughridge | 40/316 |
| 2,629,953 | 3/1953 | Safka et al. . | |
| 2,929,161 | 3/1960 | Kuyk | 40/660 |
| 3,382,545 | 5/1968 | Spenner | 24/339 |
| 4,268,986 | 5/1981 | Piana | 40/316 |
| 4,694,542 | 9/1987 | Koppe | 24/563 |
| 4,876,810 | 10/1989 | Piana et al. | 40/316 |

FOREIGN PATENT DOCUMENTS

| | | | |
|---|---|---|---|
| 383869 | 8/1931 | Belgium . | |
| 1472466 | 1/1969 | Fed. Rep. of Germany . | |
| 1640133 | 1/1971 | Fed. Rep. of Germany . | |
| 873434 | 7/1942 | France | 40/316 |
| 2606193 | 5/1988 | France . | |
| 39178 | 9/1960 | Luxembourg . | |
| 282925 | 1/1928 | United Kingdom | 24/563 |
| 746246 | 3/1956 | United Kingdom | 24/545 |

OTHER PUBLICATIONS

Mecanique Electricite 47, No. 166 (May 1963) p. 68.

*Primary Examiner*—Kenneth J. Dorner
*Assistant Examiner*—James M. Gardner
*Attorney, Agent, or Firm*—Rosenman & Colin

[57] ABSTRACT

A C-shaped support for cable marking has a lengthwise straight or S-shaped slit and at least one of its ends has one or more oblique surfaces running counterclockwise or clockwise with respect to the longitudinal central axis and with respect to the position of the slit. Before its installation on the cable, the support is positioned so that the oblique surface can be rotated clockwise or counterclockwise to widen the slit which will then close again progressively.

15 Claims, 2 Drawing Sheets

C-SHAPED SUPPORT FOR CABLE MARKING WITH AT LEAST ONE END HAVING AN OBLIQUE SHAPED SURFACE

CROSS-REFERENCE TO RELATED APPLICATION

This application is a continuation of application Ser. No. 466,476 filed Mar. 6, 1991, now abandoned, which is a continuation of Ser. No. 07/432,036 filed Nov. 3. 1989, now abandoned.

FIELD OF THE INVENTION

The invention relates to a C-shaped support, in the form of a sleeve which is open along its longitudinal edges, for electric cable marking.

BACKGROUND OF THE INVENTION

C-shaped supports are available in various configurations according to the needs for cable marking. Known C-shaped supports are usually made of elastic or mat material, on the upper surface of which the identification codes are directly printed or stamped. Other C-shaped supports are known having a transparent recess in which ring-shaped marking elements are introduced thus forming the code. Furthermore, C-shaped supports in transparent material are known in which a slip or small label bearing the printed cable code is visible through the transparent material and is clamped between the cable and sleeve.

All these C-shaped supports are mounted on the cable by applying the support on the cable with the sleeve opening facing the cable. When pressing the support against the cable, the opening widens and the C-shaped support snaps around the cable, elastically engaging it. This engagement is necessary to prevent the support from moving and rotating around the cable.

Obviously, this installation is not always easy and requires a considerable pressure on the support. Often, the support slips from the hand causing loss of time. This means that the connection and marking of cables for electrical equipment, electric power stations etc. requires special care and much labor so that simplification of the job and shorter time for installation of the coded supports will entail better work and lower cabling costs.

Furthermore, normal C-shaped supports have a rather wide gap between the edges of the C-shape, usually covering one quarter of the periphery of the installed support. A considerable wrapping section of the cable is thus lost and the clamping action of the support on the cable is limited to the remaining three-quarters of the periphery only.

The object of the invention is to modify known cable and wire markers in order to facilitate their installation on cables, to ensure that they are almost completely wrapped around the cable, and to improve the clamping action on the cable.

Known C-shaped supports have their ends formed at right angles to the longitudinal axis of the support and, as explained before, they are therefore mounted on the cable by a lateral thrust, causing at the same time opening of the longitudinal slit along its whole length.

BRIEF SUMMARY OF THE INVENTION

According to the invention, however, the ends of the C-shaped supports feature one or more oblique surfaces with respect to the longitudinal axis of the support. Thus, the slit in the support is no longer forced against the cable, but the support is applied with this oblique surface resting against the cable and is then swung on this bearing surface to force the slit onto the cable. The slit will thus widen progressively as the support is swung towards the cable, so that installation will be easier and less troublesome. As the support rests on the cable at its oblique end, it can be better seized with the fingers and is less likely to slip or fall down. Since the C-shaped support is applied to the cable at its oblique end, and no longer along its full longitudinal edges, the gap between the latter may be considerably reduced thus improving the wrapping action which will now extend around almost the whole cable periphery. The adoption of such C-shaped support with an oblique end, and its installation method on the cable will also facilitate cable marking by means of labels or coded rings, since the support during its application to the cable may be stopped in an intermediate slanting position, in which the marking elements can be readily introduced.

Obviously, according to the type of support and marking techniques, the oblique end of the support may take different configurations (simple o double oblique surface) or orientations (counterclockwise inclination opposite to the slit or clockwise inclination towards the slit or both). All these solutions are, however, based upon an installation method which requires a rotational or swinging movement of the support resting with its oblique end on the cable. This invention is illustrated in some of its practical and exemplifying implementations in the enclosed drawings.

IN THE DRAWINGS

Figure 8:
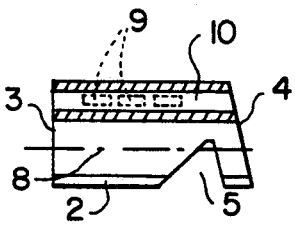
FIG. 8 shows the axial central section of a C- shaped support which is similar to FIG. 1 but is provided with a transparent recess in which to introduce the ring shaped marking elements.
Figure 9:
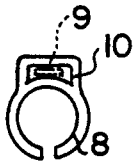
Figure 10:
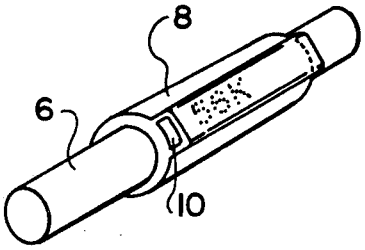
Figure 11:
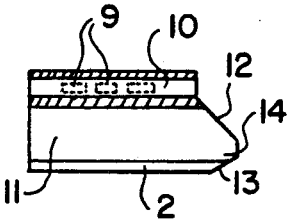
Figure 12:
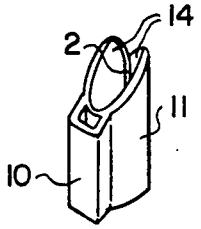
Figure 14:
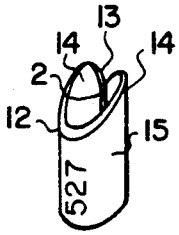
Figure 15:
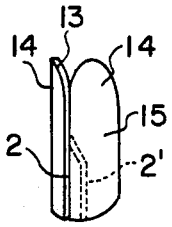
Figure 16:
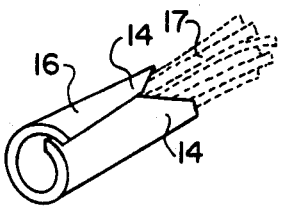
Figure 17:
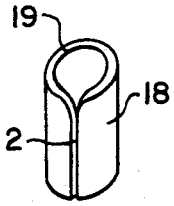
Figure 18:
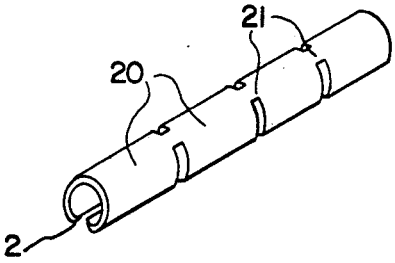
Figure 19:
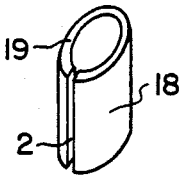
Figure 20:
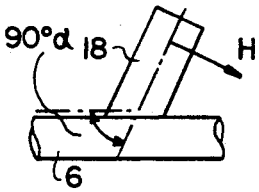
Figure 21:
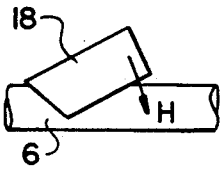
Figure 22:
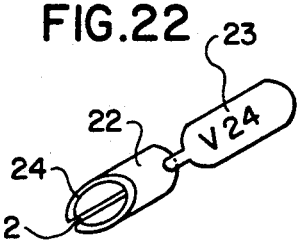
Figure 23:
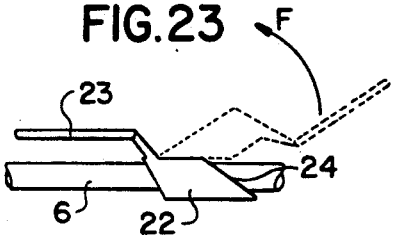

FIGS. 9 and 10 respectively show a lateral and a perspective view of the support mounted on the cable according to FIG. 8;

FIG. 11 shows a vertical central section of the C-shaped support featuring a recess and one end having a double oblique surface;

FIGS. 12 an 13 respectively show a perspective view of the support illustrated in FIG. 11 and a side view of this support cable;

FIGS. 14 and 15 respectively show a perspective front and rear view of a C-shaped support for preprinted or label marking on the support, featuring one end with a double oblique surface;

FIG. 16 shows the C-shaped support as illustrated in FIGS. 14 and 15, but with overlapping channel edges which may be useful for assembly of cable bundles;

FIG. 17 shows a perspective view of a C-shaped support in which is lowered at split level;

FIG. 18 shows a perspective view of a support assembly linked together by detachable tabs;

FIG. 19 shows a C-shaped support with its oblique end directed towards the slit;

FIGS. 20 and 21 show two assembly steps of the supports illustrated in FIGS. 17 and 19 being fitted on the cable;

FIG. 22 shown a perspective view of a C-shaped support fitted wit marker tag; and FIG. 23 shows a lateral view of the support illustrated in FIG. 22, after it has been mounted on the cable.

DESCRIPTION OF A SPECIFIC EMBODIMENT

With reference to the FIGS. 1 to 7, the C-shaped support or sleeve 1 is provided with a longitudinal slit 2. This support 1 has one end 3 cut perpendicular to its own axis, whereas the other end 4 is cut at an oblique angle of $90°+\alpha$ with respect to its longitudinal central axis defining a horizontal transverse plane 1' (see FIG. 9). In this embodiment, the obliquity is counterclockwise (see FIG. 2), the support having a longer length on the side where the slit 2 is located and a shorter length on the opposite side.

An almost rhomboidal hole 5, as shown in the drawings, is located at the oblique end 4, on the same side as the slit 2.

The support 1 is fitted on the cable 6 in the sequence illustrated in the FIGS. 3 thru 7. The oblique end 4 of the support (FIG. 3), is placed on the cable and the support is then rotated or swung counterclockwise, in the direction of the arrow F, so that the slit 2 is progressively widened in the first lower portion of the support 1. The portion of the slit 2 behind the opening 5 remains rather narrow, so that the walls of this hole 5 tend to stop the rotation of the support in the intermediate position shown in FIG. 4, which position is stable because the first portion of the support is snugly fitting around the cable.

A stable, slanting position of the support is thus achieved so that it will be easy to introduce the marker label 7 between the support and the cable. The label can be inserted without the need for holding the support in the hand end without risk that the label will slip out on the other end.

Figure 1:
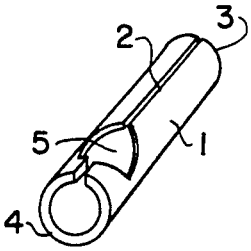
FIG. 1 shows a perspective view of a C-shaped support for labelled cable marking, featuring one oblique end and a slanting positioning hole.
Figure 2:
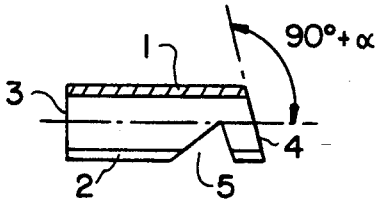
FIG. 2 shows the axial section of the support illustrated in FIG. 1.
Figure 3:
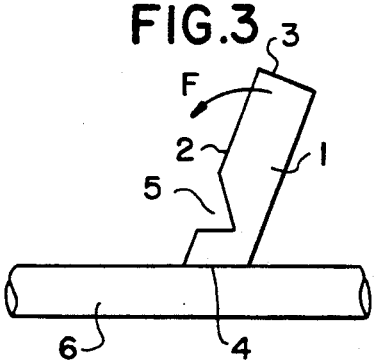
FIGS. 3, 4, 5, 6 and 7 show the installation sequence of the support (illustrated in FIG. 1) on the cable.
Figure 4:
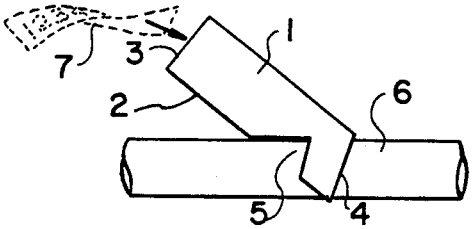
Figure 5:
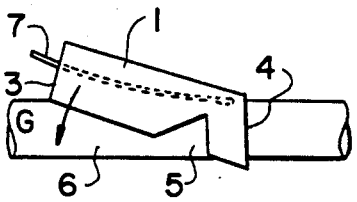
Figure 6:
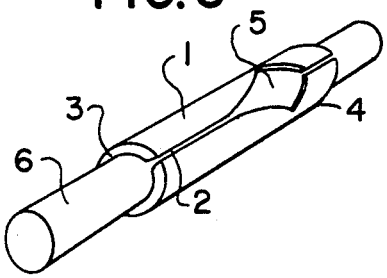
Figure 7:
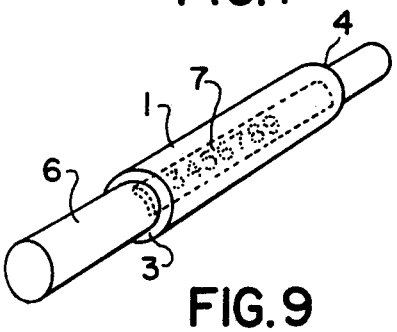

The support 1 is then further swung or rotated counterclockwise in the direction of the arrow G in FIG. 5, expanding the upper portion of the slit 2 progressively until its installation on the cable is completed as shown in FIGS. 6 and 7.

A similar solution and similar installation are adopted for support 8 featuring a slit 2 as shown in the FIGS. 8, 9 and 10. Support 8 is provided with composable coded rings 9, inserted in the transparent recess 10 of the support, according to known cable marking techniques. In this case too, the stable, inclined, intermediate positioning obtained with the aid of the hole 5, greatly facilitates the introduction of the coded rings 9 in the recess 10.

Figure 13:
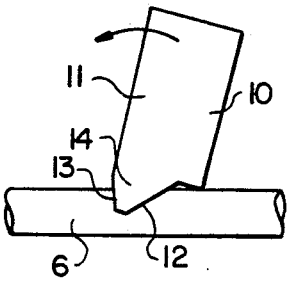

FIGS. 11, 12 and 13 show a support 11 with slit 2, cable marking being achieved by coded rings 9 introduced in the recess 10. In this case, one end of the support has two opposed oblique surfaces, i.e. one oblique surface 12 in counterclockwise direction and one oblique surface 13 in the clockwise direction terminating at the slit 2.

Two lateral projections 14 partially surrounding the cable 6 (FIG. 13), ensure the stability of the support 11 during its installation by rotation onto the cable 6 and the insertion of the coded rings 6 in the recess 10.

FIGS. 14 and 15 show a support which is similar to the sleeve shown in FIG. 11 but which can be used for marker codes preprinted on the outer surfaces of the support, opposite the slit 2, or for labels. This support 15 has two oblique surfaces 12, 13 and two lateral projections 14.

As can be seen from FIG. 15, the longitudinal slit 2, which is normally straight, may also take a nonlinear for instance S-shaped configuration as shown at 2'. This approach with a non-linear slit 2 adopted for all sleeves so far described as an alternative for the longitudinal straight slit.

FIG. 16 shows a support 16 which is similar to the support illustrated in FIGS. 14 and 15, but with slightly overlapping edges of the C-shape. This solution will extend the use of a single sized support to cables having quite different diameters. This support 16 may also be used as a clamp for cable bundles 17.

In FIGS. 17 and 18, the support 18 with the slit 2 has one end with oblique surface 19 pointing in clockwise directions $(90°+\alpha)$ towards the slit 2. In such approaches, the surface of the oblique end 19 may be either flat (FIG. 19) or may have a variable inclination, which will be more accentuated near the slit 2 (FIG. 17). The support is installed as shown in FIGS. 20 and 21 by placing the oblique surface 19 of the support on the cable and turning the latter clockwise in direction of the arrow H.

All supports described above may be prepared by molding single elements or molding linked elements. One example of such linked supports is shown in FIG. 18 in which the support 20 is linked by a detachable tab 21 to other supports.

Finally a support 22 is illustrated in FIG. 22 featuring a shelf-like plate 23 which has one counterclockwise oblique end 24.

FIG. 23 clearly shows the installation by counterclockwise rotation of such support 22 on the cable 6.

It is apparent that the invention will also cover any other supports similar to those described and illustrated herein, featuring one clockwise or counterclockwise oblique surface with respect to its longitudinal axis and mounted on the cable by positioning its oblique end on the cable and then rotating it in clockwise or counterclockwise direction, so that the slit will be progressively widened and elastically narrowed as the support snugly fits around the cable, thus facilitating installation and cable marking. The support substantially completely surrounds the cable, as shown in the drawings, resulting in a more stable fit, according to the aim of this invention.

The solutions discussed according to this invention refer to a support featuring at one end, one or more oblique surfaces with respect to its longitudinal axis, but it is also possible to provide both ends of these supports with oblique surfaces, which of course, will have to be opposite shaped.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A support for installation about, and for marking, an electrical cable, comprising:

an elongated sleeve having a central longitudinal axis defining a horizontal transverse plane and opposite ends, said sleeve being of generally C-shaped cross-section and having a slit extending longitudinally between said opposite ends, at least one of said ends of the sleeve having a planar bearing surface means obliquely inclined relative to the horizontal transverse plane for engaging the electrical cable and defining an initial pre-installed position in which the sleeve extends obliquely of the electrical cable, said inclined bearing surface means having a fulcrum means for turning the sleeve to a final installed stable position in which the sleeve co-axially surrounds and clamps onto the electrical cable about substantially the entire periphery of the electrical cable sleeve, said slit material means for progressively allowing and to open close said one end to the other of said ends of the sleeve during turning of the sleeve between the initial and final position; and cable identifier means mounted on the sleeve and visible in the final installed stable position.

2. A support as claimed in claim 1, wherein said other end of the sleeve is planar and is perpendicular to the horizontal transverse plane, and wherein the inclined bearing surface is planar and is inclined at an acute angle relative to the horizontal transverse plane.

3. A support as claimed in claim 1, wherein said other end of the sleeve is planar and is perpendicular to the horizontal transverse plane, and wherein the inclined bearing surface is planar and is inclined at an obtuse angle relative to the horizontal transverse plane.

4. A support as claimed in claim 1; and further comprising means for supporting the sleeve in a self-standing position intermediate the initial and final positions, said cable identifier means being mounted on the sleeve in the self-standing position.

5. A support as claimed in claim 1, wherein said at least one end of the sleeve includes two bearing surfaces inclined along different transverse directions and forming longitudinal projections on opposite lateral sides of the sleeve.

6. A support as claimed in claim 1, wherein the sleeve has overlapping longitudinal edges bounding the slit.

7. A support as claimed in claim 1, wherein the slit is linear and parallel to the longitudinal axis.

8. A support as claimed in claim 1, wherein the slit is curved.

9. A support as claimed in claim 1, wherein each opposite end of the sleeve has a bearing surface inclined at different angles of inclination relative to the longitudinal axis.

10. A support as claimed in claim 1, wherein the sleeve is a one-piece molded part of resilient material.

11. A support as claimed in claim 1, wherein the sleeve is detachably connected to additional sleeves.

12. A support as claimed in claim 1, wherein the cable identifier means is a strip having a code thereon.

13. A support for installation about, and for marking, an electrical cable, comprising:

an elongated sleeve having opposite ends and a central longitudinal axis defining a horizontal transverse plane, said sleeve being of generally C-shaped cross-section and having a slit extending longitudinally between said opposite ends, at least one of said ends of the sleeve having a bearing surface inclined relative to the longitudinal axis and engaging the electrical cable in an initial pre-installed position in which the sleeve extends transversely of the electrical cable, said inclined bearing surface having a fulcrum about which the sleeve is turned to a final installed stable position in which the sleeve co-axially surrounds the clamps onto the electrical cable about substantially the entire periphery of the electrical cable, said slit progressively opening and closing from said one end to the other of said ends of the sleeve during turning of the sleeve between the initial and final positions, said sleeve having sleeve portions bounding an opening located on said slit and between said opposite ends of the sleeve, said sleeveportions of said opening being inclined relative to, and intersecting, said horizontal transverse plane defined by said longitudinal axis, said sleeve portions of said opening engaging the cable in a self-standing position intermediate of the initial and final positions; and cable identifier means mounted on the sleeve in the self-standing position and being visible in the final installed stable position.

14. A method of marking an electrical cable, comprising the steps of:

forming an elongated sleeve having opposite ends with a central longitudinal axis defining a horizontal transverse plane;

obliquely inclining at least one of said ends relative to the horizontal transverse plane to form a planar inclined bearing surface;

forming a slit that extends longitudinally between said opposite ends to form the sleeve with a generally c-shaped cross-section;

initially engaging the inclined bearing surface against the electrical cable in an initial pre-installed position in which the sleeve extends obliquely of the electrical cable;

turning the sleeve about a fulcrum on the inclined bearing surface to a final installed position in which one sleeve co-axially surrounds the clamps onto the electrical cable about substantially the entire periphery of the electrical cable, said slit progressively opening and closing from said one end to the other of said ends of the sleeve during the turning step; and mounting cable identifier means on the sleeve in a visible location in the final installed position.

15. A method as claimed in claim 4; and further comprising the step of supporting the sleeve in a self-standing position intermediate the initial and final positions, and mounting step being performed in the self-standing position.

* * * * *

UNITED STATES PATENT AND TRADEMARK OFFICE

CERTIFICATE OF CORRECTION

PATENT NO. : 5,157,853

DATED : October 27, 1992

INVENTOR(S) : Ivana Piana et al

It is certified that error appears in the above-identified patent and that said Letters Patent is hereby corrected as shown below:

Col. 5, lines 11-15 should read as follows:

trical cable sleeve material means for allowing said slit to progressively open and close from said one end during turning of the sleeve between the initial and final positions, said sleeve having sleeve portions bounding an opening located on said slit and between said opposite ends of the sleeve, said sleeve portions of said opening being inclined relative to, and intersecting, said horizontal transverse plane defined by said longitudinal axis, said sleeve portions of said opening engaging the cable in a self-standing position intermediate the initial and final positions; and Signed and Sealed this Twenty-seventh Day of September, 1994

*Attest:*

Bruce Lehman

BRUCE LEHMAN

*Attesting Officer*

*Commissioner of Patents and Trademarks*